US008659384B2

(12) United States Patent
Dietsch et al.

(10) Patent No.: US 8,659,384 B2
(45) Date of Patent: Feb. 25, 2014

(54) METAL FILM SURFACE MOUNT FUSE

(75) Inventors: G. Todd Dietsch, Park Ridge, IL (US); Olga Spaldon-Stewart, Des Plaines, IL (US)

(73) Assignee: Littelfuse, Inc., Chicago, IL (US)

( * ) Notice: Subject to any disclaimer, the term of this patent is extended or adjusted under 35 U.S.C. 154(b) by 224 days.

(21) Appl. No.: 12/883,055

(22) Filed: Sep. 15, 2010

(65) Prior Publication Data

US 2011/0063070 A1 Mar. 17, 2011

Related U.S. Application Data

(60) Provisional application No. 61/243,009, filed on Sep. 16, 2009.

(51) Int. Cl.
*H01H 85/04* (2006.01)

(52) U.S. Cl.
USPC ..... 337/292; 337/290; 337/297

(58) Field of Classification Search
USPC ..... 337/290, 292, 283, 297
See application file for complete search history.

(56) References Cited

U.S. PATENT DOCUMENTS 4,263,574 A * 4/1981 Mori et al. ..... 337/161
5,166,656 A * 11/1992 Badihi et al. ..... 337/297
5,228,188 A * 7/1993 Badihi et al. ..... 29/623
5,296,833 A * 3/1994 Breen et al. ..... 337/297
5,432,378 A * 7/1995 Whitney et al. ..... 257/529
5,586,014 A 12/1996 Hasegawa
5,726,621 A * 3/1998 Whitney et al. ..... 337/297
5,864,277 A * 1/1999 Grimm et al. ..... 337/297
5,914,649 A * 6/1999 Isono et al. ..... 337/290
5,939,969 A * 8/1999 Doerrwaechter et al. ..... 337/297
5,977,860 A 11/1999 Ulm et al.
6,034,589 A * 3/2000 Montgomery et al. ..... 337/296
6,040,755 A * 3/2000 Abe et al. ..... 338/22 R
6,452,475 B1 * 9/2002 Kawazu et al. ..... 337/290
6,838,972 B1 * 1/2005 Minervini et al. ..... 338/22 R
7,116,208 B2 * 10/2006 Nishimura et al. ..... 337/296
7,190,044 B1 3/2007 Cheng et al.
7,367,114 B2 * 5/2008 Rybka et al. ..... 29/623
7,385,475 B2 * 6/2008 Bender et al. ..... 337/297
7,460,003 B2 12/2008 Hsu et al.
8,081,057 B2 * 12/2011 Chiu ..... 337/297
2004/0034993 A1 * 2/2004 Rybka et al. ..... 29/623
2004/0169578 A1 9/2004 Jollenbeck et al.
2007/0052063 A1 3/2007 Ueda
2007/0210411 A1 9/2007 Hovis et al.
2009/0027821 A1 * 1/2009 Colby et al. ..... 361/104

OTHER PUBLICATIONS

International Search Report dated Nov. 10, 2010, for PCT/US2010/049062 Filed.

* cited by examiner

*Primary Examiner* — Anatoly Vortman
(74) *Attorney, Agent, or Firm* — Kacvinsky Daisak Bluni PLLC

(57) ABSTRACT

A chip fuse includes a plurality of parallel fusible link layers disposed between a corresponding plurality of insulating glass layers deposited on a substrate and laminated together. The fusible link layers are interconnected between the glass layers without the need for vias. A first of the plurality of fusible link layers extends beyond a cover disposed over the chip fuse and one of the glass layers to form a first electrical terminal connection. Another of the plurality of the fusible link layers also extends beyond the cover and another of the glass layers to form a second electrical terminal connection.

18 Claims, 3 Drawing Sheets

METAL FILM SURFACE MOUNT FUSE

BACKGROUND OF THE INVENTION

1. Field of the Invention

Embodiments of the invention relate to the field of circuit protection devices. More particularly, the present invention relates to a metal film surface mount fuse configured to provide over current protection to circuits in high ambient temperature environments.

2. Discussion of Related Art

Metal film current protection devices are employed to protect circuit components in which space limitations on boards is at a premium. Typically, the larger the current or voltage capacity needed for a particular circuit, the larger the fuse dimensions. However, real estate on circuit boards upon which the protected electrical circuit is mounted is very limited. In addition, these fuses are used in high current and high ambient temperature environments necessitating the need for temperature stability and performance reliability.

Subminiature fuses mountable on circuit boards have been provided to protect electrical circuits from high voltage and/or high current use. For example, miniature fuses have been employed having a plurality of metalized layers disposed on a substrate to form a laminated structure. The layers are interconnected, in series or parallel depending on the particular application, using metalized holes or vias. The layers are punched at particular locations and metalized using an electrically conductive paste to form the interconnecting vias. End caps or pads are formed on the ends of the fuse to provide connection to the electrical circuit being protected. However, the creation and metalization of the vias to interconnect the layers requires increased manufacturing time and costs to ensure process and device reliability. Accordingly, there is a need to provide a chip fuse that is configured to provided performance reliability in high ambient temperature environments while allowing for decreased manufacturing time and associated costs.

SUMMARY OF THE INVENTION

Exemplary embodiments of the present invention are directed to a chip fuse. In an exemplary embodiment, a chip fuse includes a substrate, a plurality of fusible link layers disposed on the substrate each layer having at least one end electrically connected to an end of another layer. A plurality of insulating layers is disposed between the plurality of fusible link layers. The plurality of insulating layers disposed on the substrate.

In another exemplary embodiment, a chip fuse includes a substrate, a plurality of fusible link layers, a plurality of insulating layers and a cover. A first insulating layer is disposed on the substrate. A first fusible link layer is disposed on the first insulating layer where the first fusible link layer has a first end and a second end. The first end defines a first terminal portion for connection to an electrical circuit. A second insulating layer is disposed at least partially on the first fusible link layer. A second fusible link layer is disposed on the second insulating layer. The second fusible link layer has a first end and a second end. The first end of the second fusible link layer is connected to the second end of the first fusible link layer. A third insulating layer is disposed at least partially on the second fusible link layer. A third fusible link layer is disposed on the third insulating layer. The third fusible link layer has a first end connected to the second end of the second fusible link layer and a second end defining a second terminal portion for connection to the electrical circuit.

DESCRIPTION OF EMBODIMENTS

Figure 1:
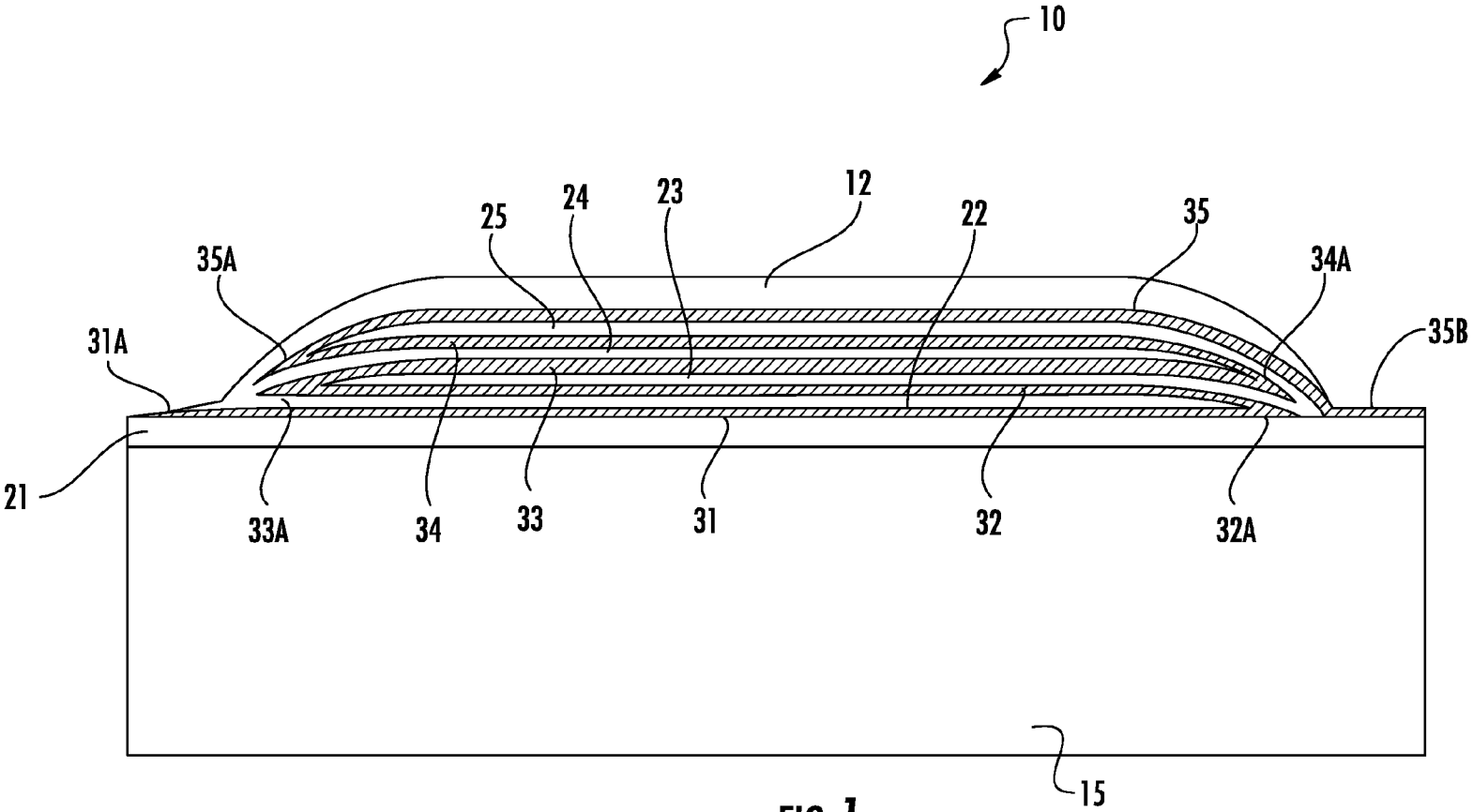
FIG. 1 illustrates a cross-sectional view of a chip fuse in accordance with an embodiment of the present invention.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. In the following description and/or claims, the term "disposed on", along with its derivatives, may be used. In particular embodiments, "disposed on" may be used to indicate that two or more layers are in direct physical and/or electrical contact with each other. However, disposed on may also mean that two or more layers may not be in direct contact with each other, but yet may still cooperate and/or interact with each other. In addition, disposed on may also mean that As used herein, the terms "disposed on" is intended to include layers FIG. 1 is a cross-sectional view of a chip fuse 10 having a cover or top layer 12, a substrate or bottom layer 15, a plurality of intermediate insulating or glass layers 21, 22, 23, 24 and 25 and a plurality of intermediate fusible link layers 31, 32, 33, 34 and 35 all of which are laminated together. The cover 12, glass layers 21, 22, 23, 24 and 25 and fusible link layers 31, 32, 33, 34 and 35 may be deposited on bottom layer 15 having a desired radius of curvature to increase surface area and associated over current response characteristics. Although five (5) intermediate fusible link layers and five (5) glass layers are described herein, any number of intermediate layers may be employed depending on the desired over current rating and particular circuit application. The fusible link layers 31, 32, 33, 34 and 35 are metallic conductors and may be, for example silver and/or material coated with a silver alloy which are deposited in a serpentine like configuration interposed with glass layers 21, 22, 23, 24 and 25. Cover 12 in an insulating material and may be, for example, a glass material and may be the same or different from glass layers 21, 22, 23, 24 and 25.

A first insulating or glass layer 21 is disposed on substrate 15 which may be a ceramic or other similar material. The first fusible link layer 31 is disposed over first glass layer 21. Second glass layer 22 is disposed over first fusible link layer 31 sufficient for a first terminal end portion 31A to extend beyond coverage of the glass layer 22 and cover 12 to provide a first connection to an electrical circuit. Second fusible link layer 32 is disposed over second glass layer 22 and is connected to and/or integrally deposited with first fusible link layer 31 at end portion 32A. This interconnection of fusible link layers 31 and 32 at end portion 32A obviates the need for vias formed through the insulating layers to connect each of the fusible link layers. In other words, the insulating layers are continuous between each of the fusible link layers so that no vias are formed therethrough to connect the fusible link layers disposed on the top and bottom of the respective insulating layer.

Third glass layer 23 is deposited over second fusible link layer 32. Third fusible link layer 33 is disposed over third glass layer 23 and is connected to and/or integrally deposited with second fusible link layer 32 at end portion 33A. Fourth glass layer 24 is deposited over third fusible link layer 33. Fourth fusible link layer 34 is deposited over fourth glass layer 24 and is connected to and/or integrally deposited with third fusible link layer 33 at end portion 34A. Fifth glass layer 25 is deposited over fourth fusible link layer 34. Fifth fusible link layer 35 is deposited over fifth glass layer 25 and is connected to and/or integrally deposited with fourth fusible link layer 34 at end portion 35A. A second terminal end portion 35B is formed by extension of fifth fusible link layer 35 beyond coverage of cover 12 to provide a second connection to an electrical circuit. Each of the end portions 32A, 33A, 34A, and 35A are tapered to provide reliable interconnection areas obviating the need for filled vias. In this manner, multiple physically parallel electrical pathways formed by fusible link layers 31, 32, 33, 34 and 35 are electrically in series and configured to provide higher transient current pulse capacity without the formation of vias for interconnection between the fusible link layers.

Figure 2:
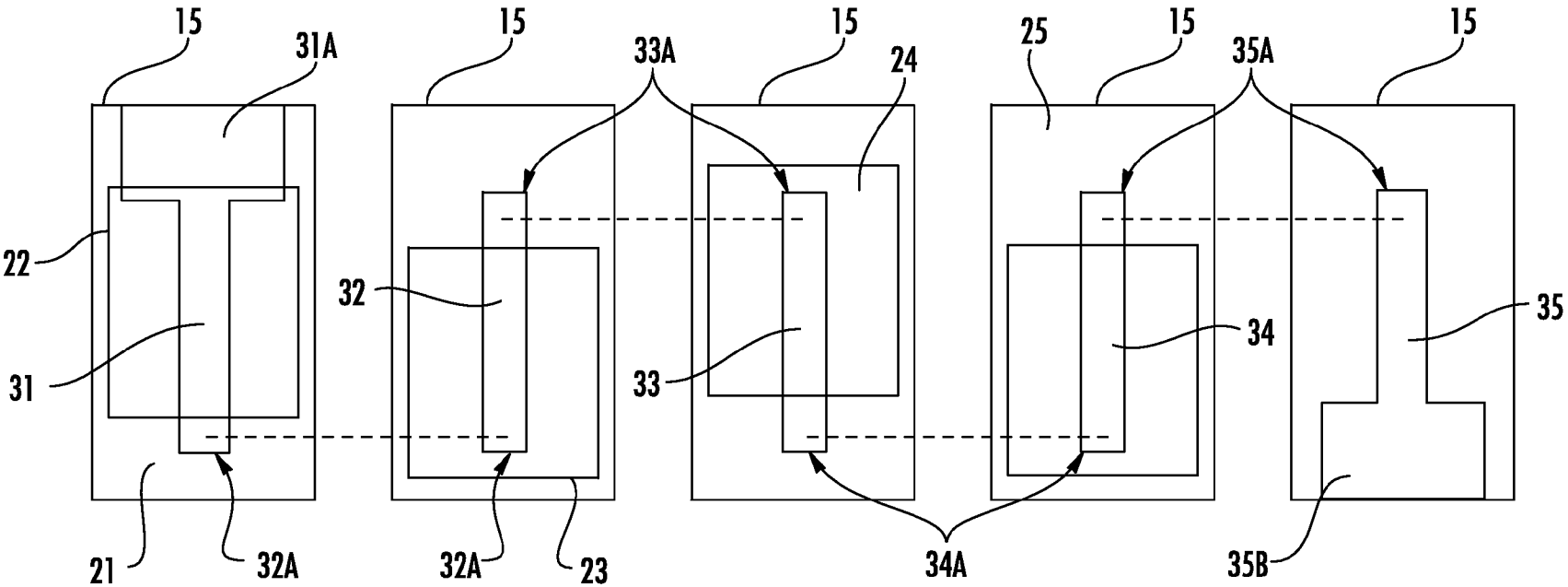
FIG. 2 illustrates a partitioned top plan view of the plurality of layers defining the chip fuse shown in FIG. 1 in accordance with an embodiment of the present invention.

FIG. 2 is a partitioned top plan view of each of the glass layers 21, 22, 23, 24 and 25 and fusible link layers 31, 32, 33, 34 and 35 deposited on substrate 15. In particular, first fusible link layer 31 is deposited on first glass layer 21. Second glass layer 22 is deposited over first fusible link layer 31 such that a first portion 31A extends outside the deposition of glass layer 22 to form a connection point or pad to an electrical circuit to be fusibly protected. Second fusible link layer 32 is deposited over second glass layer 22 and is connected to the first fusible link layer 31 at portions 32A. As can be seen, second glass layer 22 is disposed between first fusible link layer 31 and second fusible link layer 32 sufficient to provide insulation therebetween except for connection area portions 32A.

Figure 3:
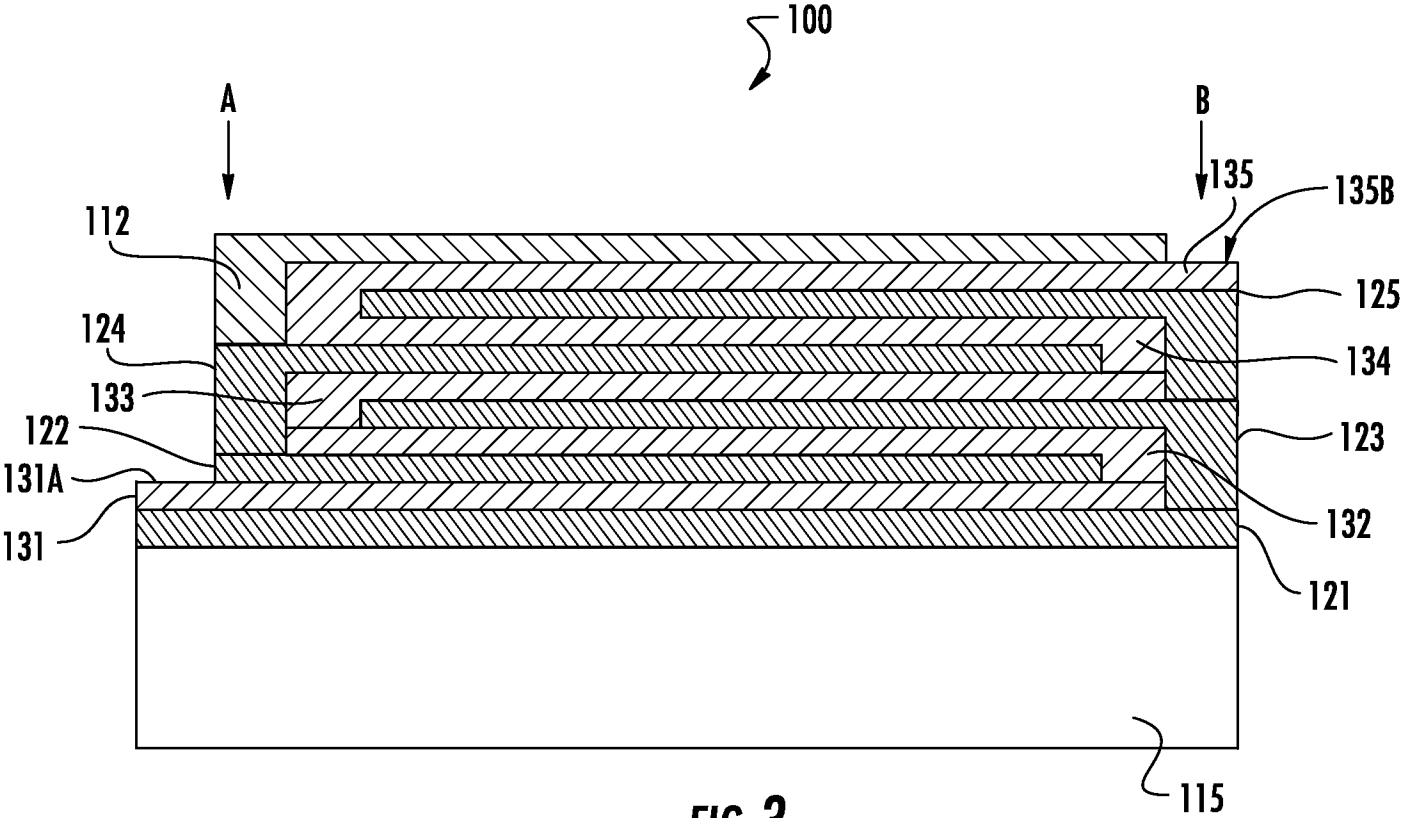
FIG. 3 is a cross-sectional view of an alternative embodiment of a chip fuse in accordance with an embodiment of the present invention.

Third glass layer 23 is deposited over second fusible link layer 32 to provide an insulating layer between second and third fusible link layers 32 and 33. Third fusible link layer 33 is deposited over third glass layer 23 and is connected to the second fusible link layer 32 at portions 33A. Fourth glass layer 24 is deposited over third fusible link layer 33 to provide an insulating layer between third and fourth fusible link layers 33 and 34. Fourth fusible link layer 34 is deposited over fourth glass layer 24 and is connected to the third fusible link layer 33 at portions 34A. Fifth glass layer 25 is deposited over fourth fusible link layer 34 to provide an insulating layer between fourth and fifth fusible link layers 34 and 35. Fifth fusible link layer 35 is deposited over fifth glass layer 25 and is connected to the fourth fusible link layer 34 at portions 35A. Cover 12, not shown, is deposited over fifth fusible link layer 35 such that a portion 35B is exposed to form a connection point or pad to an electrical circuit to be fusibly protected FIG. 3 is a cross-sectional view of an alternative embodiment of chip fuse 100 having a cover or top layer 112, a substrate or bottom layer 115, a plurality of intermediate insulating or glass layers 121, 122, 123, 124 and 125 and a plurality of intermediate fusible link layers 131, 132, 133, 134 and 135 all of which are laminated together. The cover 112, glass layers 121, 122, 123, 124 and 125 and fusible link layers 131, 132, 133, 134 and 135 may have a substantially planar geometry deposited on bottom layer 115. Although five (5) intermediate fusible link layers and five (5) glass layers are described herein, any number of intermediate layers may be employed depending on the desired over current rating and particular circuit application. In addition, for ease of explanation, one end of chip fuse 100 is designated as A and a second end of chip fuse 100 is designated as B. The fusible link layers 131, 132, 133, 134 and 135 are metallic conductors and may be, for example silver which are deposited in a serpentine like configuration interposed with glass layers 121, 122, 123, 124 and 125. A first insulating or glass layer 121 is deposited on substrate 115 which may be a ceramic or other similar material. The first fusible link layer 131 is deposited on first glass layer 121. Second glass layer 122 is deposited on first fusible link layer 131 sufficient for a first terminal 131A to be defined by the extension of fusible link layer 131 beyond cover 112 and coverage of glass layers 122 and 124 to provide a first connection to an electrical circuit. Second fusible link layer 132 is deposited on second glass layer 122 and is connected to and/or integrally deposited with first fusible link layer 131 near end portion A.

Each of the interconnections between the fusible link layers obviates the need for vias formed through the glass layers to connect each of the fusible link layers. Third glass layer 123 is deposited on second fusible link layer 132 and connects with first glass layer 121 near end portion B. Third fusible link layer 133 is deposited on third glass layer 123 and is connected to and/or integrally deposited with second fusible link layer 132 near end portion A. Fourth glass layer 124 is deposited on third fusible link layer 133 and connects with second glass layer 122 near end portion A. Fourth fusible link layer 134 is deposited on fourth glass layer 124 and is connected to and/or integrally deposited with third fusible link layer 133 near end portion B. Fifth glass layer 125 is deposited on fourth fusible link layer 134 and is connected to third glass layer 123 near end portion B. Fifth fusible link layer 135 is deposited over fifth glass layer 125 and is connected to and/or integrally deposited with fourth fusible link layer 134 near end portion A. Second terminal 135B is formed by extension of fifth fusible link layer 135 beyond coverage of cover 112 to provide a second connection to an electrical circuit.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claims is:

1. A chip fuse comprising:

a substrate;

a plurality of fusible link layers disposed on said substrate, each layer having a first end and a second end; and a plurality of insulating layers disposed between said plurality of fusible link layers, said plurality of insulating layers disposed on said substrate;

wherein said first end of a first one of said plurality of fusible link layers and said second end of a second one of said plurality of fusible link layers extend beyond one of said plurality of insulating layers disposed therebetween and are in direct physical and electrical contact with one another where said first end of the first one of said plurality of fusible link layers and said second end of the second one said plurality of fusible link layers extend beyond the one of said plurality of insulating layers disposed therebetween; and wherein said first end of the second one of said plurality of fusible link layers and said second end of a third one of said plurality of fusible link layers extend beyond one of said plurality of insulating layers disposed therebetween and are in direct physical and electrical contact with one another where said first end of the second one of said plurality of fusible link layers and said second end of the third one of said plurality of fusible link layers extend beyond the one of said plurality of insulating layers disposed therebetween.

2. The chip fuse of claim 1 further comprising an insulating cover disposed on said plurality of fusible link layers and said plurality of insulating layers.

3. The chip fuse of claim 2 wherein at least one of said plurality of fusible link layers has an end defining a terminal portion.

4. The chip fuse of claim 3 wherein said terminal portion is a first terminal portion, said chip fuse further comprising a second terminal portion defined at an end of a last of said plurality of fusible link layers, said insulating cover configured to expose said first and second terminal portions wherein said first and second terminal portions define connection points to an electrical circuit.

5. The chip fuse of claim 1 wherein all of said plurality of fusible link layers, said plurality of insulating layers, said cover and said substrate are laminated together.

6. The chip fuse of claim 1 wherein at least one of said plurality of fusible link layers has a radius of curvature with respect to said substrate such that a surface area of said at least one of said plurality of fusible link layers is associated with a particular over-current response characteristic.

7. The chip fuse of claim 1 wherein each of said plurality of fusible link layers has a radius of curvature with respect to said substrate such that a surface area said plurality of fusible link layers is associated with a particular over-current response characteristic.

8. The chip fuse of claim 7 further comprising an insulating cover disposed over said plurality of fusible link layers and said plurality of insulating layers, said cover having a radius of curvature corresponding to the radius of curvature of said plurality of fusible link layers.

9. The chip fuse of claim 1 wherein each of said ends of said plurality of fusible link layers is tapered to provide a reliable electrical connection therebetween.

10. The chip fuse of claim 1 wherein said plurality of fusible link layers are disposed on said substrate physically in parallel with respect to each other.

11. The chip fuse of claim 1 wherein said plurality of insulating layers are disposed on said substrate physically in parallel with respect to each other.

12. The chip fuse of claim 3 wherein said first terminal portion defines a pad for a first connection to said electrical circuit.

13. The chip fuse of claim 4 wherein said second terminal portion defines a pad for a second connection to said electrical circuit.

14. The chip fuse of claim 1 wherein a first of said plurality of insulating layers is disposed between a top surface of said substrate and a first of said plurality of fusible link layers.

15. The chip fuse of claim 1 wherein said plurality of insulating layers and said plurality of fusible link layers are substantially planar with respect to said substrate.

16. A chip fuse comprising:

a substrate;

a first insulating layer disposed on said substrate;

a first fusible link layer disposed on said first insulating layer, said first layer having a first end and a second end, said first end defining a first terminal portion for connection to an electrical circuit;

a second insulating layer disposed at least partially on said first fusible link layer;

a second fusible link layer disposed on said second insulating layer, said second fusible link layer having a first end and a second end, wherein said first end of said second fusible link layer and said second end of said first fusible link layer extend beyond said second insulating layer and are in direct physical and electrical contact with one another where said first end of said second fusible link layer and said second end of said first fusible link layer extend beyond said second insulating layer;

a third insulating layer disposed at least partially on said second fusible link layer; and a third fusible link layer disposed on said third insulating layer, said third fusible link layer having a first end and a second end, wherein said first end of said third fusible link layer and said second end of said second fusible link layer extend beyond said third insulating layer and are in direct physical and electrical contact with one another where said first end of said third fusible link layer and said second end of said second fusible link layer extend beyond said third insulating layer, and said second end of said third fusible link layer defines a second terminal portion for connection to the electrical circuit.

17. The chip fuse of claim 16 wherein said first, second and third fusible link layers forming a continuous electrical conductive path from said first terminal portion to said second terminal portion.

18. The chip fuse of claim 16 further comprising an insulating cover disposed on said fusible link layers and said insulating layers, said insulating cover configured to expose said first and second terminal portions.

* * * * *